United States Patent [19]

Ikeda

[11] Patent Number: 4,992,307

[45] Date of Patent: Feb. 12, 1991

[54] METHOD AND APPARATUS FOR IMPREGNATING A LIQUID INTO WOOD AND FAR-INFRARED-RAY PANEL HEATING STRUCTURE

[76] Inventor: Nobuo Ikeda, 22-12,, Aza Matsuzaki, Sotoasahikawa Akita-shi, Akita, Japan

[21] Appl. No.: 244,901

[22] Filed: Sep. 15, 1988

[30] Foreign Application Priority Data

May 25, 1988 [JP] Japan ..... 63-128101
Jun. 3, 1988 [JP] Japan ..... 63-74149[U]

[51] Int. Cl.[5] ..... B05D 5/00
[52] U.S. Cl. ..... 427/297; 427/8
[58] Field of Search ..... 427/8, 247; 118/50, 118/50.1, 429, 713

[56] References Cited

U.S. PATENT DOCUMENTS 866,487 9/1907 Kuckuck ..... 118/712
1,081,158 12/1913 Shipley ..... 118/712
1,838,585 12/1931 Smith ..... 118/712
2,140,981 12/1938 Booty et al. ..... 427/297
2,668,779 2/1954 Herman ..... 427/297

*Primary Examiner*—Stanley Silverman
*Attorney, Agent, or Firm*—Lackenbach, Siegel, Marzullo & Aronson

[57] ABSTRACT

A method and apparatus for impregnating a liquid such as a resinous liquid into wood, in which timbers to be subjected to the impregnation are placed in a presure tank which is capable of reducing or increasing the interior pressure thereof; the inside of the pressure tank is evacuated through a monitoring timber identical in properties with the timbers to be subjected to the impregnation, to expel the air present in the tank and the timbers; the liquid is injected into the pressure tank under pressurized conditions, while continuing the evacuation, to impregnate the liquid into the timbers; and the impregnation is completed when the liquid begins to flow out of the tank through the monitoring timber.

7 Claims, 8 Drawing Sheets

METHOD AND APPARATUS FOR IMPREGNATING A LIQUID INTO WOOD AND FAR-INFRARED-RAY PANEL HEATING STRUCTURE

BACKGROUND OF THE INVENTION

This invention relates to a method and apparatus for impregnating wood with a treating liquid such as a resinous liquid.

This invention further relates to a far-infrared-ray panel heating structure, and more particularly to a far-infrared-ray heating structure using wood impregnated with a synthetic resin as panels.

Heretofore, various impregnation methods and apparatuses have been known. In these methods and apparatuses, various treating liquids are impregnated into wood to impart the wood with flame retardant resistance, impart the wood with dimensional stability, improve the strength of the wood, improve the moth resistance or corrosion resistance of the wood, or color the wood to widen the application use of the wood, enhancing the value of the products. However, conventional apparatuses are not satisfactory in treating efficiency, working efficiency, economy, and improvement has been awaited. Furthermore, there has been no easy means to know how much treating liquid has been impregnated into the wood. Thus, the treatment has only depended upon operator's skill.

On the other hand, recently, the utilization of far infrared rays has been put in lime light. In especial, various uses in heating systems have been proposed. A far infrared ray radiator often includes ceramics. For example, zirconium oxide ceramics such as silicon carbide, aluminum oxide, silicon oxide, titanium oxide. Of course, non-oxide ceramics may alternatively be used. Such a far infrared ray radiator is used for various kinds of far-infrared-ray heater including a stove. However, it is not used as a floor board which persons directly touch. As floor boards, plywood is usually used. Since floor boards of natural wood are liable to be deformed when dried, the floor boards of natural wood are not heated to provide direct floor heating.

However, if the conventional far-infrared-ray radiating material is used for a heating apparatus, or plywood is used for floor heating, a room furnished with such a heating apparatus will give an artificial impression and can never give an air of traditional room using natural wood. However, if plywood is used to cover the far infrared ray radiating material, an effect of far infrared rays is lowered. Improvement is needed for this respect, too.

SUMMARY OF THE INVENTION

It is a first object of the present invention to provide a method and apparatus for impregnating a liquid into wood which is capable of obtaining good liquid impregnation effect and yet reducing the number of steps for the impregnation.

It is a second object of the present invention to provide a method and apparatus for impregnating a liquid into wood which is capable of knowing a liquid impregnation status of wood visually, while continuing the treatment.

It is a third object of the present invention to provide a far-infrared-ray panel heating structure which utilizes the phenomenon that natural wood radiates far infrared rays upon heating and wood impregnated with a synthetic resin radiates stronger far infrared rays.

A method for impregnating a liquid into wood according to the present invention is a method for impregnating a liquid such as a resinous liquid into wood in a pressure tank which is capable of increasing or reducing an interior pressure.

In a first step, the inside of the pressure tank, which contains timbers to be impregnated with the liquid, is subjected to evacuation through a monitoring timber substantially identical with said timbers.

In a second step, the liquid into the pressure tank is injected under pressurized conditions, while continuing the evacuation of the inside of the tank;

The impregnation of the timbers with the liquid is continued until the liquid begins to be drawn out of the pressure tank through the monitoring timbers.

Another method for impregnating a liquid into wood is a method comprises the following steps: In a first step, timbers to be impregnated are charged in a container having an opening at a top thereof, filling the container with the liquid and placing the container in the pressure tank.

In a second step, air in the pressure tank is evacuated to reduce the interior pressure of the pressure tank so that the air present in the timbers to be impregnated is expelled together with the air in the tank.

In a third step, another evacuation line initiating from the container is formed, a monitoring timber identical or similar, in properties, with or to the timbers to be impregnated is placed at an intermediate position of said another evacuation line, and the inside of the container is evacuated by a suction force larger than a suction force for the pressure tank to expel the air present in the liquid or adhering to surfaces of the timbers from the pressure tank.

In a final, fourth step, the inside of the pressure tank is pressurized, while continuing the pressure reducing of the interior pressure of the pressure tank to impregnate the timbers with the liquid, while expelling the air retained in the container and/or the residual air in the timbers.

An apparatus for impregnating a liquid into wood comprises a pressure tank for accomodating timbers to be subjected to the impregnation, which is capable of reducing or increasing an interior pressure thereof., a plurality of monitoring units connected to a suction pipe of the pressure tank; each of said monitoring units holding a monitoring timber substantially identical in properties with the timbers accommodated in the pressure tank; an evacuating means for the liquid and air in the pressure tank through the suction pipe and the monitoring timbers; and a pressurizing means for impregnating the liquid into the pressure tank under pressurized conditions; whereby impregnation state of the liquid into the timbers can be known through the monitoring timbers of the respective monitoring units, without suspending the liquid impregnation into the timbers. This apparatus operates as follows:

First, the inside of the pressure tank containing the timbers therein is subjected to evacuation through the monitoring timbers. Then, the liquid such as a resinous liquid is injected into the pressure tank under pressurized conditions, while continuing the evacuation. The completion of the impregnation can be known by confirming that the liquid flows out of the pressure tank through the monitoring timbers.

Another apparatus for impregnating a liquid such as a resinous liquid into wood according to the present invention comprises a pressure tank which is capable of increasing or reducing an interior pressure; a container having an opening at a top thereof for accommodating timbers to be impregnated and filling the liquid therein; a first evacuating means for evacuating air in the pressure tank to reduce the interior pressure of the pressure tank so that the air present in the tank is expelled out of the tank and the air present in the timbers to be impregnated is expelled; a second evacuating means for evacuating the liquid in the container by a suction force larger than a suction force for the pressure tank to expel the air present in the liquid or adhering to surfaces of the timbers from the pressure tank; and a monitoring device provided in a evacuation line between the pressure tank and the means for evacuating the inside of the container.

In this apparatus, said monitoring device includes a filter section connected to the pressure reducing line and a monitoring section which is situated under the filter section and integrally assembled therewith. Said filter section has a monitoring timber connected to the pressure reducing line, which is identical or similar, in properties, with or to the timbers.

The first and second evacuating means may be a single means. In this case, the means is needed to develop two different suction forces.

First, timbers to be impregnated are charged in a container having an opening at a top thereof, filling the container with the liquid and placing the container in the pressure tank.

Then, air in the pressure tank is evacuated by the first evacuating means to reduce the interior pressure of the pressure tank. As a result of this, the air present in the timbers to be impregnated is expelled together with the air in the tank.

Further, another evacuation line initiating from the container is formed, a monitoring timber identical or similar, in properties, with or to the timbers to be impregnated is placed at an intermediate position of said another evacuation line, and the inside of the container is evacuated by a suction force larger than a suction force for the pressure tank to expel the air present in the liquid or adhering to surfaces of the timbers from the pressure tank.

Finally, the inside of the pressure tank is pressurized, while continuing the pressure reducing of the interior pressure of the pressure tank. As a result of this, a pressure difference between the inside of the container and the inside of the monitoring section becomes larger and larger. Then, the air retained in the container and/or the residual air in the timbers are vigorously expelled out of the pressure tank and the liquid is impregnated into the timbers simultaneously. When most of the air within the pressure tank is expelled out of the pressure tank, the liquid begins to drip into the monitoring section of the monitoring unit through the monitoring timber. Since the monitoring timber is selected to have identical or similar, in properties, with or to the timbers to be treated, it can be known that the treating liquid has been impregnated into the timbers when the dripping of the liquid is visually confirmed through the monitoring window of the monitoring section.

Wood or timbers to which the present invention is applicable are not critical, but they may be, for example, a coniferous tree such as a Japanese ceder, a Japanese red pine, a black pine, a Japanese larch, a silver fir, a fir, a Japanese hemlock, an elm, a hinoki cypress, a sawara cypress, a Japanese spruce, a Japanese yew tree, a hiba arborvitae, etc.; or a broadleaf such as a birch, a Japanese beech, a zelkova tree, an oak, a maple tree, a Japanese linden, an elm, a halopanax, a quercus acutissima, a Japanese oak, a chinquapin, a cherry tree, a horse chestnut, a paulownia, a katsura tree, a lauan, a mahogany, an apitong, an agathis, a teak, an oak, a rosewood, an ebony, etc.

The shape of the timbers to be treated in the present invention is not critical and it may be a round timber, a veneer or a rectangular timber so long as it may be charged in the container. The timbers to be treated may be processed wood such as plywood, laminated materials, or particle boards or fiber boards.

As a treating liquid for imparting flame retardation, there may be mentioned, a liquid containing a flame retardant agent, for example, an inorganic water-soluble salt such as diammon hydrogen phosphate or boric acid, or a metal oxide such as a sulfamic acid, a halide, a compound containing phosphorus and nitrogen, guanidine compound or antimony oxide.

As a treating liquid for imparting dimensional stability, there may be mentioned a solution or a dispersion of, for example, a polyether such as polyethylene glycol, polypropylrene glycol; polyethylene glycol mono-(meta-)acrylate, a saturated polyester resin, poly-(meta-)acrylic ester or a copolymer thereof, urethane resin, polyvinyl alcohol, parafin, vinyl acetate copolymer, polyamide resin, polyimino resin, aminoplast resin, fluoroplastics, silicon resin, vinyl copolymer resin, SBR or NBR.

As a treating liquid for reinforcement, there may be mentioned, for example, a solution or dispersion of a monomer such as styrene, (meta)acrylate, vinyl acetate, diallyl phthalate, divinylbenzene, (meta)acrylic acid, acrylonitrile, vinylidene chloride, unsaturated polyester resin and styrene monomer, a reactive polyurethane resin, phenolic resin, alkyd resin, urea resin, melamine resin, vinyl ester, epoxy resin, etc.

As a treating liquid for imparting rot-resistance, there may be described a liquid containing a antiseptic agent, for example, a copper compound, chromium compound, arsenic compound, boron compound, pentachlorophenol, metalic salt of naphthenate, organotin compound, chloronaphthalenes, 8-quinolinol, captans, creosote oil, walman salt, zinc chloride chromate, etc.

As a treating liquid for imparting moth resistance, there may be mentioned a liquid containing a mothproofing agent, for example, walman salt, polyden salt, organic phosporus compounds, carbamates, organotin compounds, chlordane, heptachlor, dieldrin, aldrin, thiodine, γ-BHC (1, 2, 3, 4, 5, 6-hexachlorocyclohexane), DDT(1,1,1-trichloro-2, 2-bis (p-chlorophenyl) ethane), methoxychloro (1, 1, 1-trichloro-2, 2-bis (p-methoxyphenyl) ethane), toxaphene, kepone, sulfonamides, thiothene oil, or organic thiocyanates.

As a treating liquid for coloring the wood, there may be mentioned a solution or dispersion of, for example, a direct dye such as chrisophenine GX or direct brown M, an acid dye such as suminol fast orange PO or suminol fast brown R, a basic dye such as safranine, or auramine, an alcoholic dye, or an oil-soluble dye. These dyes may be used with a fixing agent and/or a surface active agent according to necessity.

As a medium for preparing these treating liquids, there may be mentioned, for example, water, alcohols, glycols, aromatic hydrocarbons, fatty hydrocarbons, aliphatic hydrocarbons, ketones, esters, halides, acids, dioxane tetrahydrofuran, DMF, DMSO, etc.

The viscosity of the treating liquid according to the present invention is determined in relation with the properties of the wood to be treated, and, in general, it is preferred to be 1,000 cps or lower.

The evacuation treatment of the present invention is preferably carried out at an absolute pressure of 160 Torr or lower. At a pressure higher than that, a gas present in the wood to be treated can not efficiently expelled.

The pressurizing treatment of the present invention is preferably carried out at a pressure of 1 to 50 $Kg/cm^2$, more preferably at 8 to 50 $Kg/cm^2$. The higher the pressurization, the higher the effect of the impreganation to the wood is. However, some wood may possibly be deformed when subjected to a high pressure.

As described above, the monitoring timber is provided to preferentially expel the air containing in the treating liquid and the inside of the timbers or on the surfaces of the timbers and to confirm the penetration of the treating liquid through the timbers. However, their mechanisms are not known. It, however, is presumed that conduit pipes of the monitoring timbers function as a filter for separating low-molecular materials such as air from high-molecular materials. The monitoring timber is preferably identical with the timbers to be treated, but it suffices to be similar to the timbers.

So-called bonding water of the waters contained in the timbers lower than a fiber saturation point enters a non-crystalline region of the wood and adheres cell walls to cause swelling. As a result of this, the strength of wood is lowered as the water content increases. The liquid impregnation treatment of the present invention using the above-mentioned resins etc. has better results as the water content of the wood is lowered. Therefore, it is advantageous that hydroxyl group in the cells of the timbers to be treated is substituted with hydrophobic group prior to the liquid impregnation treatment.

This treatment is carried out by dipping the timbers to be treated in a treating liquid of a suitable concentration, for example, of 2% of formalin. Through this treatment, the hydroxyl groups of the bonding water contained in the timbers are liberated and hydrophobic groups are bonded in place of the hydroxyl groups. Thus, it becomes difficult to absorb water and rarely cause swelling. More particularly, the above-identified liquid impregnation treatment using the resinous liquids is carried out after the treatment using formalin, the timbers can have improved dimensional stability, strength and water resistance.

The treatment for substituting the hydroxyl groups within the timbers to be treated with the hydrophobic groups is carried out by acetylation using acetic anhydride, pyridine, acetates or dimethyl formamide, propionylation using propinic acids etc., butylation using butylic acids etc., laurylation using lauric acid, benzyl esterification using sodium hydroxide, benzyl chloride etc., formalization using formaldehyde, plasticization using liquid ammonia or aqueous ammonia, carboxymethylation, arylation, or ethylation.

When formalin is used for the treatment as described above, hydroxyl groups of cellulose of the timbers react with formaldehyde to produce methylene ether. The cross-linkage of the methylene ether further enhances dimensional stability of the timbers. At the same time, the absorption of water is much lowered. The formalization is accelerated when magnesium chloride is added to the treating liquid to function as a catalyst.

The far-infrared-ray panel heating structure according to the present invention uses a panel made of wood impregnated with synthetic resins etc. according to the method and using the apparatus as described above, which radiates far infrared rays when heated, and has a heating source behind the panel. The heating source is not limited to an electric one, but it may be of gas heating, hot-water heating.

DETAILED DESCRIPTION OF PREFERRED EMBODIMENT

Preferred embodiment of the present invention will now be described, referring to drawings.

Figure 1:
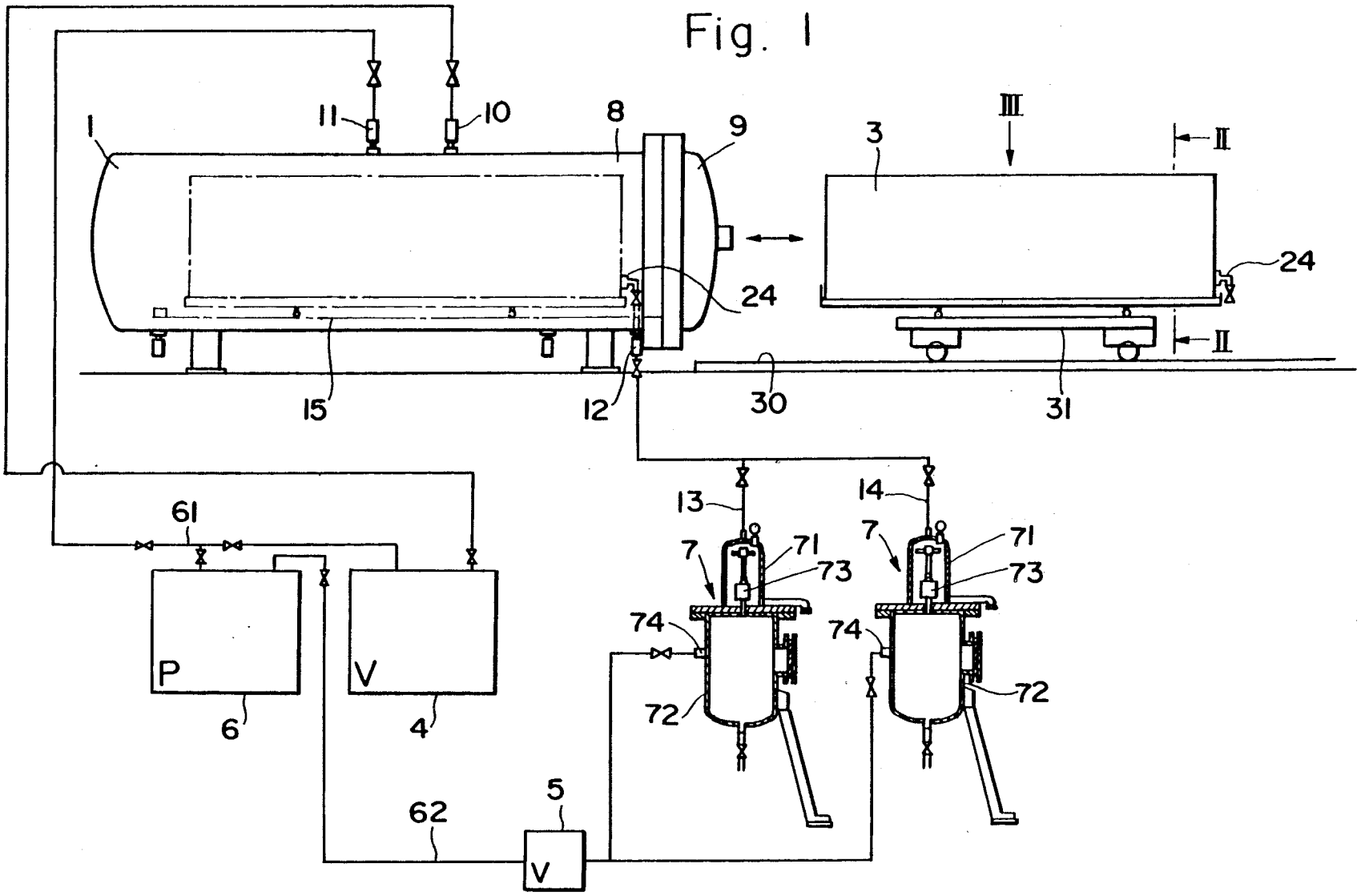
FIG. 1 is a schematic view of one form of a resin impregnating apparatus embodying the present invention.

FIG. 1 illustrates one form of a method and apparatus for impregnating liquid into wood, embodying the present invention. The liquid impregnating apparatus of this embodiment essentially consists of a pressure tank 1 which is capable of increasing or reducing an internal pressure, a container 3 which accomodates wood to be treated and contains a treating liquid filled therein, a pressure reducing units 4, 5 for reducing an interior pressure of the pressure tank 1, a pressurizing unit 6 for pressurizing the inside of the pressure tank 1 and supplying pressurized air to the pressure reducing units 4, 5, and a pair of monitoring units 7, 7.

The pressure tank 1 comprises a hollow cylindrical drum portion 8, a cap portion 9 which is openably fitted to an end of the drum portion 8. The pressure tank 1 is fixed on a base through legs. A pressure reducing nozzle 10 and a pressurizing nozzle 11 are provided at upper portions of the tand 1. The pressure reducing nozzle 10 is connected to the pressure reducing unit 4 and the pressurizing nozzle 11 is connected to the pressurizing unit 6. A suction pipe 12 is provided at a lower portion of the drum portion 8 of the tank 1. A pair of treating liquid pipes 13, 14 connected to the suction pipe 12 are connected to the pressure reducing unit 5 through the monitoring units 7, 7, respectively. The pressure tank 1 has a rail 15 for receiving the container 3 therein.

A rail 30 is provided in front of the cap portion 9 of the pressure tank 1. The container 3 is received in or taken out of the pressure tank 1 by a truck 31.

Figure 2:
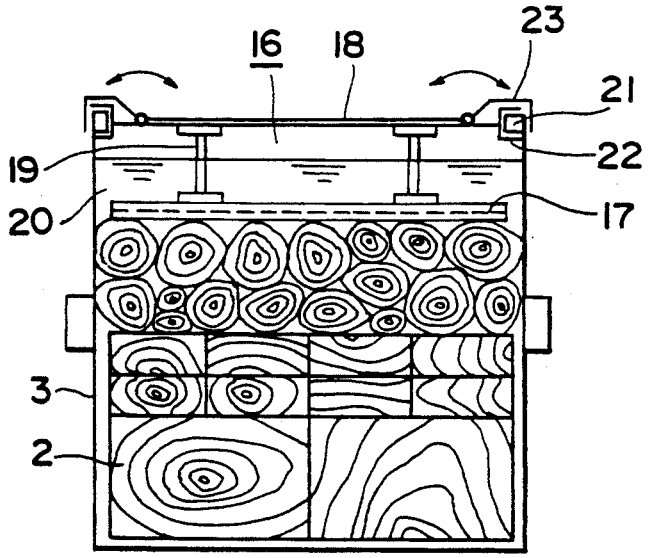
FIG. 2 is an enlarged sectional view of a pressure tank taken along line II—II of FIG. 1.
Figure 3:
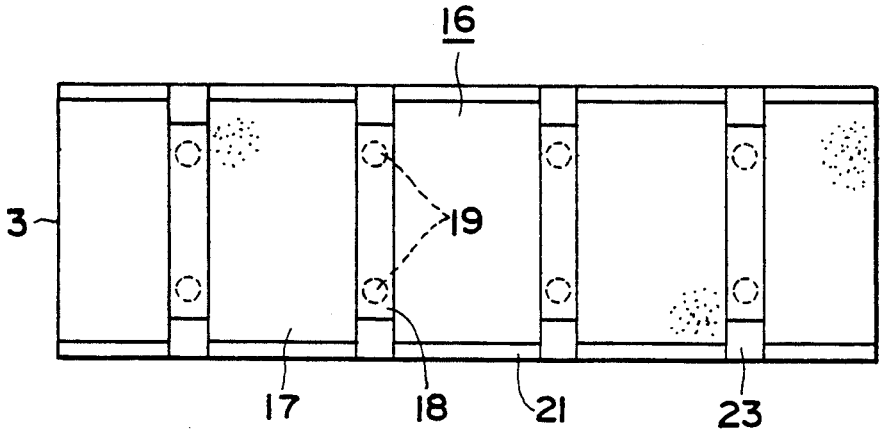
FIG. 3 is an enlarged plan view of the pressure tank seen from an arrow III of FIG. 1.

The container 3 is rectangular pallalelopiped in shape as illustrated in FIGS. 2 and 3 and it opens at the top to charge the wood 2 therethrough. A mesh plate 17 for dispersing bubbles which covers substantially all over the upper opening 16 of the container 3 above the wood 2 to be treated which is accommodated in the container 3. A plurality of air cylinders 19 are provided between the mesh plate 17 and a stop bar 18. The air cylinders 19 are extended when the treating liquid 20 is filled in the container 3 to prevent the wood 2 from coming up to the surface. The mesh plate 17 has a number of fine openings (not shown) all over the surface to finely disperse bubbles coming out of the wood 2 which come up through the treating liquid 20.

The stop bar 18 is formed of a pair of thin steel plates. The lower steel plate has, at both side ends thereof, mounting portions 22 formed in a channel shape which are adapted to fit around edges 21 of the container 3, respectively. The upper steel plate has hook portions 23 which are adapted to hook the edges 21 of the container 3, respectively. Each of the hook portions 23 has a hinged portion to be folded centrally. With this arrangement, after the wood 2 to be treated, the mesh plate 17 and the air cylinders 19 are set in the container 3, the hook portions 23 of the upper steel plate may be bent inwardly and the mounting portions of the lower steel plate are fitted around the respectively corresponding edges and then the hook portions 23 are extended to hook the edges, respectively. Thus, the stop bar 18 is firmly secured to the container 3 to complete a mechanism for preventing the wood from coming up to the surface. Since the wood 2 to be treated, especially rectangular lumber, are charged closely in the container 3 in FIG. 3, it is necessary to allow air extracted from the wood to be treated to easily release upwardly. For example, small wood pieces may be inserted between the wood 2. However, when logs are charged, no means are needed to release the air as can be seen from FIG. 2.

An outlet pipe 24 with a valve which communicates the inside of the container 3 with the suction pipe 12 of the pressure tank 1 is provided at a lower portion of a aide of the container 3. When the container 3 is received in the pressure tank 1, the outlet pipe 24 is just above the suction pipe 12. In this position, the valve of the outlet pipe 24 and an upper end of the suction pipe 12 are connected.

The pressure reducing unit 4 is a first vacuum suction means which evacuate the air inside the pressure tank 1 to discharge the air inside the tank 1 to reduce the interior pressure of the tank 1 and to draw air contained within the wood to be treated out of the same. The pressure reducing unit 5 is a second vacuum suction means which sucks the treating liquid 20 within the container 3 by a vacuum suction larger than the vacuum suction for the pressure tank 1 to draw bubbles present within the treating liquid 20 or adhering to the surface of the wood 2 to be treated and discharge the same out of the pressure tank 1.

Both the pressure reducing units 4, 5 are provided to evacuate the air within the pressure tank 1 and reduce the interior pressure of the tank 1. The pressure reducing units 4, 5 each have a plurality of nozzle blocks 25.

Figure 4:
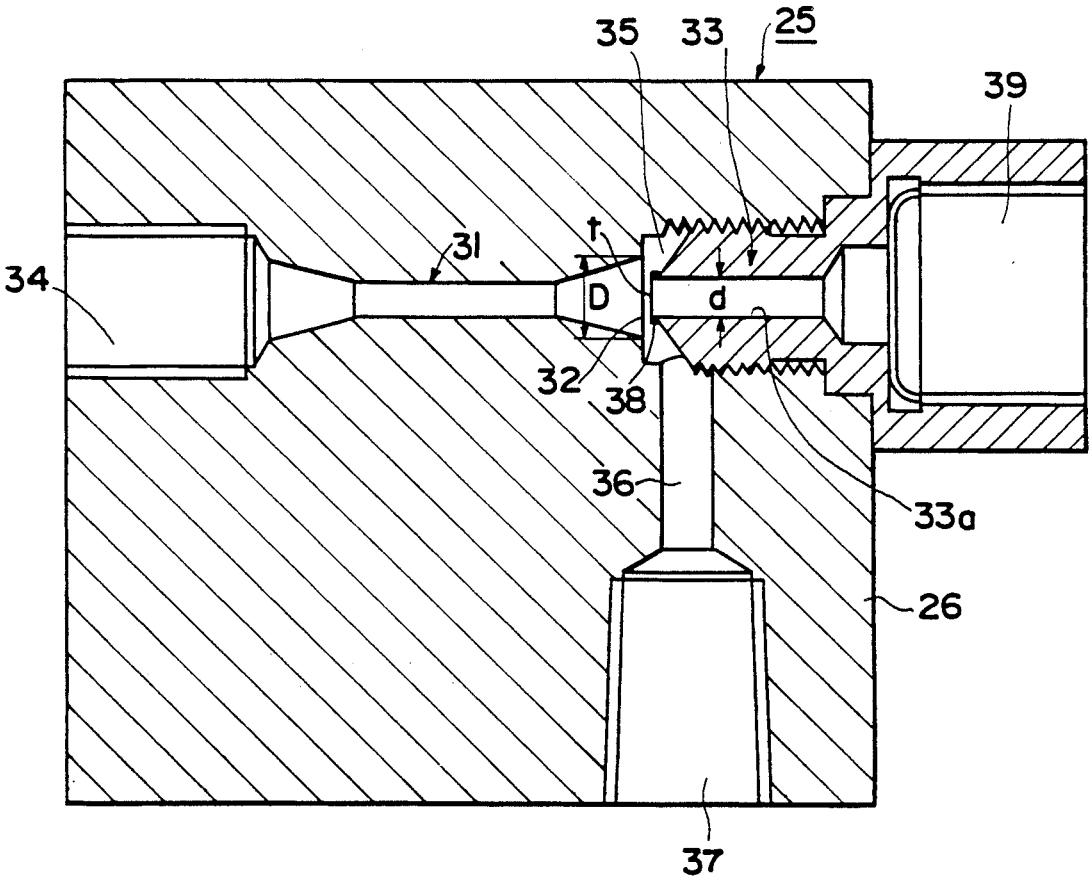
FIG. 4 is an enlarged sectional view of a nozzle block of a pressure reducing unit.

The nozzle block 25 has a throat 31 formed in a block body 26 and a nozzle 33 in fitted at a forward end opening 32 of the throat 31 as illustrated in FIG. 4. The entire length of the nozzle block 25 is about 45 mm. The forward end opening 32 of the throat 31 has a sectoral shape so that an opening diameter D of the outer end of the opening to an opening diameter d of the nozzle slot 33*a* is D=1.5 d. The nozzle slot starts at a position spaced t (about 0.5 mm) from a rear end of the nozzle 33. The throat 31 also has a sectoral opening at its rear end portion which communicate with a discharge opening 34. A base end portion of the nozzle 33 is threadedly held in a room 35 of the block body 26. A suction opening 36 opening inside the room 35 is communicated with a suction opening 37.

The base portion of the nozzle 33 has an outer contour consisting of a cylindrical portion which extends slightly (0.3 mm in length) 38 from the base end and and a conical portion (2 mm in length in an axial direction) expanding from the forward end of the cylindrical portion 38. In the nozzle block 25 of FIG. 4, the nozzle slot 33*a* communicates with an inlet 39 of compressed air. The inlet 39 of the compressed air is connected to outlet lines 61, 62 of the pressurizing unit 6 (for example, compressor) and the intake 37 is connected to the pressure reducing nozzle 10 and the monitoring unit 72 through a pressure reduced tank in the pressure reducing unit.

Figure 5:
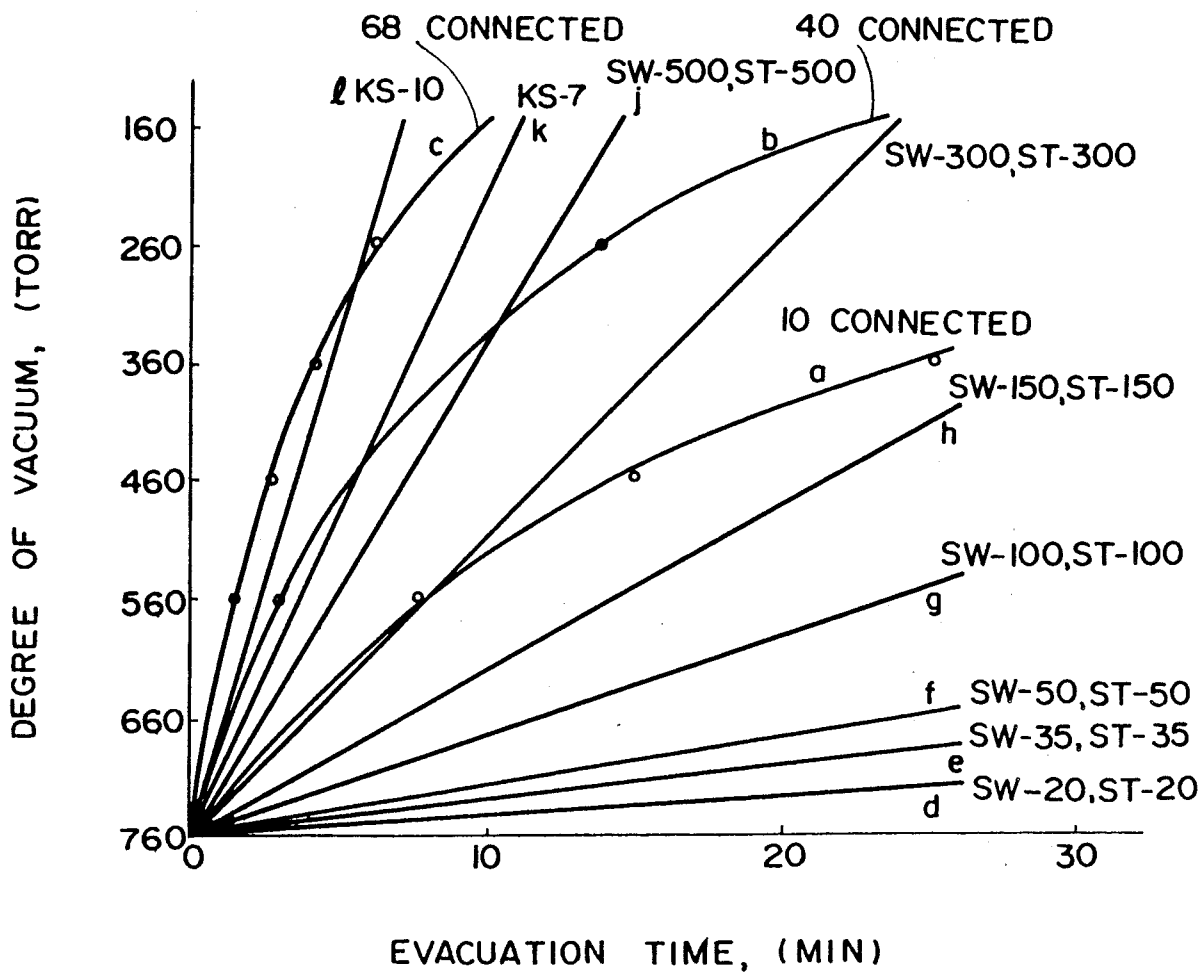
FIG. 5 is a graph showing an ability of the nozzle block of FIG. 4.
Figure 7:
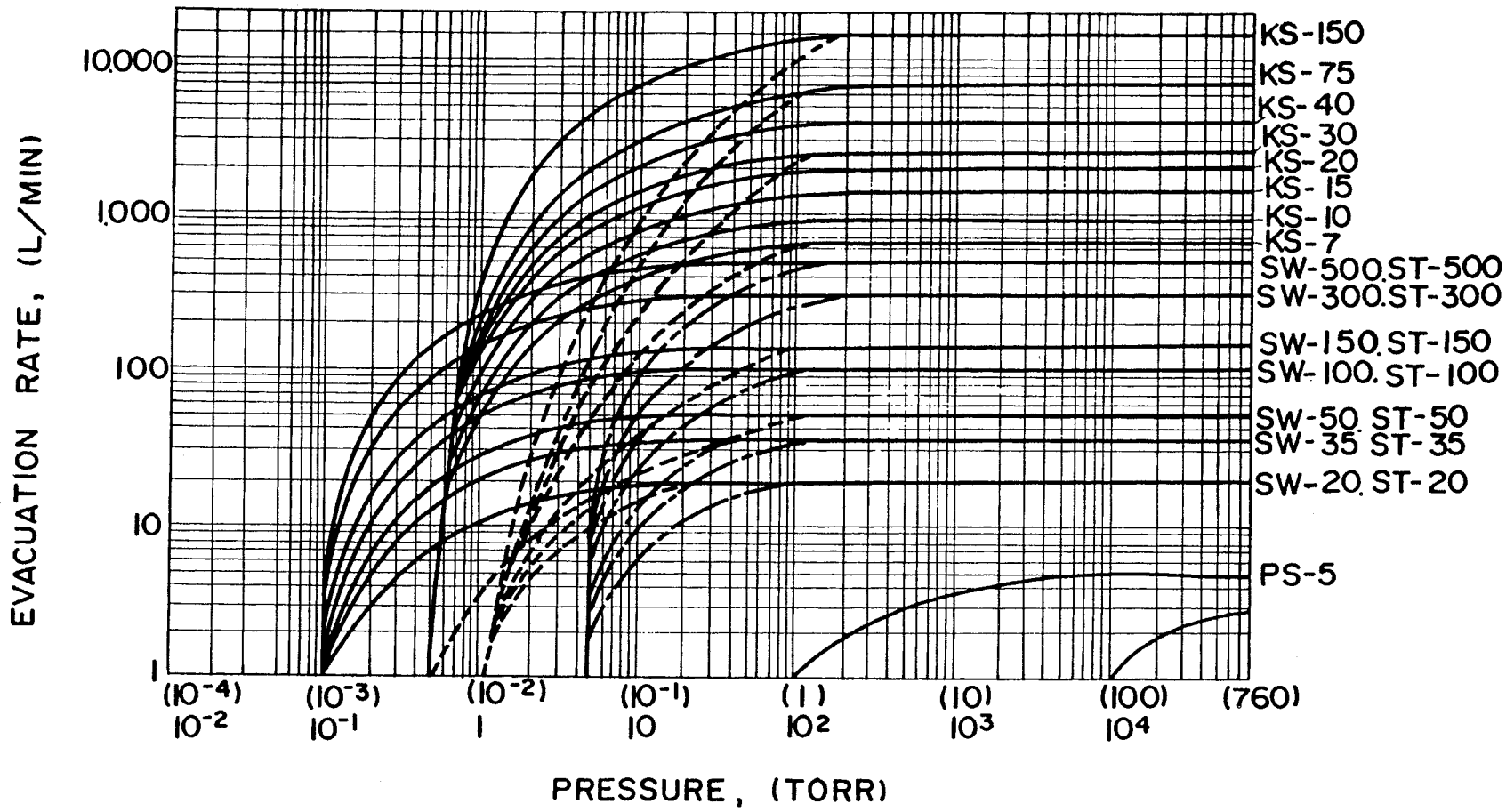
FIG. 7 is a graph showing curves of a vacuum pump evacuation rate for obtaining the ability of FIG. 5.

FIG. 5 shows test results of evacuation effects attained by the pressure reducing unit employing the nozzle blocks 25. An object to be subjected to evacuation is a vacuum pressure tank with a container of 9095 1. In the figure, a shows a degree of vacuum-time curve for the vacuum pressure tank with 10 nozzle blocks connected in parallel, b shows a similar curve for the vacuum pressure tank with 40 nozzle blocks connected in parallel and c shows the vacuum pressure tank with 68 nozzle blocks connected in parallel. Straight lines d to l are also shown for comparative tests conducted by using a vacuum pump manufacatured and sold by Sato Shin-kuu Kikai Kogyo Kabushiki Kaisha of 1036, Fujikubo, Miyoshicho, Iruma-gun, Saitama-ken). The lines d to l are obtained by calculating performance characteristics of FIG. 7. In the figure, numerals after SW and ST, respectively, indicate exhaust velocity (1/min) and numerals after KS indicate 1/100 of the exhaust velocity.

When 68 nozzle blocks 25 are connected (curve c), the n vacuum pressure tank of the present invention develops much stronger vacuum suction as compared with a vacuum pump (as indicated by straight lines h and i of FIG. 5) of substantially the same cost. More particularly, when the nozzle blocks of this structure are used, vacuum suction of substantially the same level as developed by an expensive vacuum pump can be obtained at a more reasonable cost. Furthermore, the vacuum pump needs periodical check and maintenance operation to maintain its performances. In contrast, the pressure reducing unit using the nozzle blocks 25 may be free from maintenance operation. In addition, advantageously, the number of nozzle blocks to be connected may be selected freely. Therefore, a desired vacuum suction can be easily obtained and the configuration of the system can be varied easily.

Figure 6:
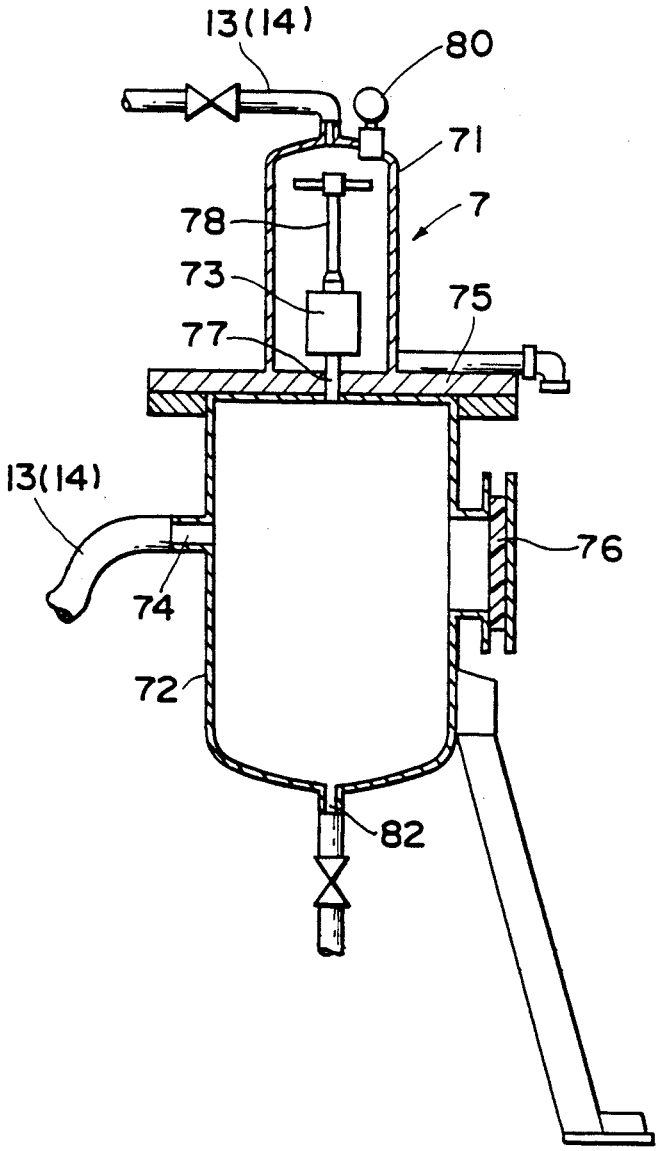
FIG. 6 is an enlarged sectional view of a monitoring unit.

FIG. 6 is an explanatory view showing a detail of the monitoring unit. The monitoring unit 7 comprises a filter section 71 connected to the treating liquid pipe 13 (14) and a monitoring section 72 situated under the filter section 71 and secured integrally thereto.

The filter section 71 is connected to the treating liquid pipe 13 (14) and adapted to hold a monitoring wood 73 which is identical with the wood 2 to be treated or similar thereto.

The treating liquid pipe 13 (14) is connected to an upper portion of the filter section 71 and a socket 74 provided on a side of the monitoring section 72 is connected to a pressure reducing line. The filter section 71 is separated from the monitoring section 72 by a base plate 75, but the former is communicated with the latter through a connecting tube 77 which extends through the base plate 75. The monitoring wood 73 is removably held on an upper end of the connecting tube 77 to close the opening of the tube. With this arrangement, the air and treating liquid 20 entering the filter section 71 is introduced into the monitoring section 72 only through the monitoring wood 73.

The monitoring section 72 has a monitoring window 76 provided to see dripping of the treating liquid 20 which has passed through the monitoring wood 73. It can be known whether the treating liquid 20 has passed through the monitoring wood 73 or not by watching the dripping of the liquid through the window 76.

The monitoring section 7 further has a manometer 80 and a drain 82.

Although a couple of monitoring units are provided in the embodiment as illustrated, one monitoring unit would suffice to carry out the invention.

The operation of the present embodiment will now be described.

First, a suitable number of timbers 2 to be treated are placed in the container 3 and they are fixed in position by the mesh plate 17, the stop bar 18 and the air cylinder 19. The treating liquid 20 is then poured into the container. The treating liquid 20 is filled until the timbers 2 are under the surface of the liquid. The container 3 is then introduced into the pressure tank 1 by using the truck 31 and the rail 15 and after the container is situated in the tank, the cap 9 is closed.

Then, the pressurizing unit 6 is operated and the pressure reducing unit 4 is operated to evacuate the pressure tank 1 to 160 Torr or lower by the pressure reducing nozzle 10 provided at the upper portion of the pressure tank 1. After the pressure tank 1 has reached the desired evacuated state, the tank 1 is still evacuated for 10 to 120 minutes. Thus, the air in the timbers 2 to be treated is expelled from the timbers 2.

At the same time, the pressure reducing unit 5 as shown in FIG. 1 is operated to draw out the treating liquid 20 through the suction pipe 12 provided at the lower portion of the pressure tank 1 at a pressure (about 60 Torr) lower than the interior pressure of the pressure tank 1. As a result of this, the air contained in the treating liquid 20 or adhering to the surface of the timbers 2 to be treated is extracted towards the monitoring unit 7 through the treating liquid pipes 13, 14.

The pressure reducing nozzle 10 at the upper portion of the pressure tank 1 is then closed and compressed air at a pressure of 8 to 40 $Kg/cm^2$ is fed into the pressure tank 1 by the pressurizing nozzle 11 at the upper portion of the pressure tank 1. The pressurizing by the compressed air and the evacuation by the pressure reducing unit 5 are continued for 10 to 120 minutes.

Upon pressurizing of the inside of the pressure tank 1, the treating liquid 20 flows towards the monitoring unit 7 of a lower pressure side since the treating liquid 20 is subjected to evacuation. At this time, since the air retained in the treating liquid 20 and the residual air within the timber 2 to be treated are light in weigh and high in flowability, they are gathered in the monitoring timber 73, passing through the monitoring timber 73, and are introduced into the monitoring section 72 prior to the treating liquid 20.

As the pressurizing injection proceeds, flowing of the treating liquid 20 into the monitoring section 72 will be observed through the monitoring window 76. At this time, it is confirmed that the impregnation with or penetration of the treating liquid 20 into the timbers 2 placed in the container 3 has been completed.

Thereafter, the operations of the relevant units are stopped and the interior pressure of the pressure tank 1 is restored to a normal pressure and the cap 9 of the pressure tank 1 is opened to transfer the container 1 onto the truck 31. Thus, the timbers treated with the liquid are taken out of the tank 1.

When a liquid was injected into beech wood by using the apparatus of the present embodiment, the impregnation rate of tahe treating liquid was 115 to 129 wt % (average value: 121 wt %). Before the present invention, the impregnation rate was 70 to 80 wt % or lower.

The present invention may of course by applied to acetylated or formalized timbers. The experiments conducted by the inventors have revealed that the timbers may preferably be dipped in 10% aqueous solution of acetic anhydride or 2% aqueous solution of formalin for some hours to effect acetylation or formalization prior to the liquid impregnation treatment of the present invention as described above. In this case, the amount of the liquid to be impregnated is generally 15% of the weight of the timbers to be treated (after acetylation or formalization).

Figure 8:
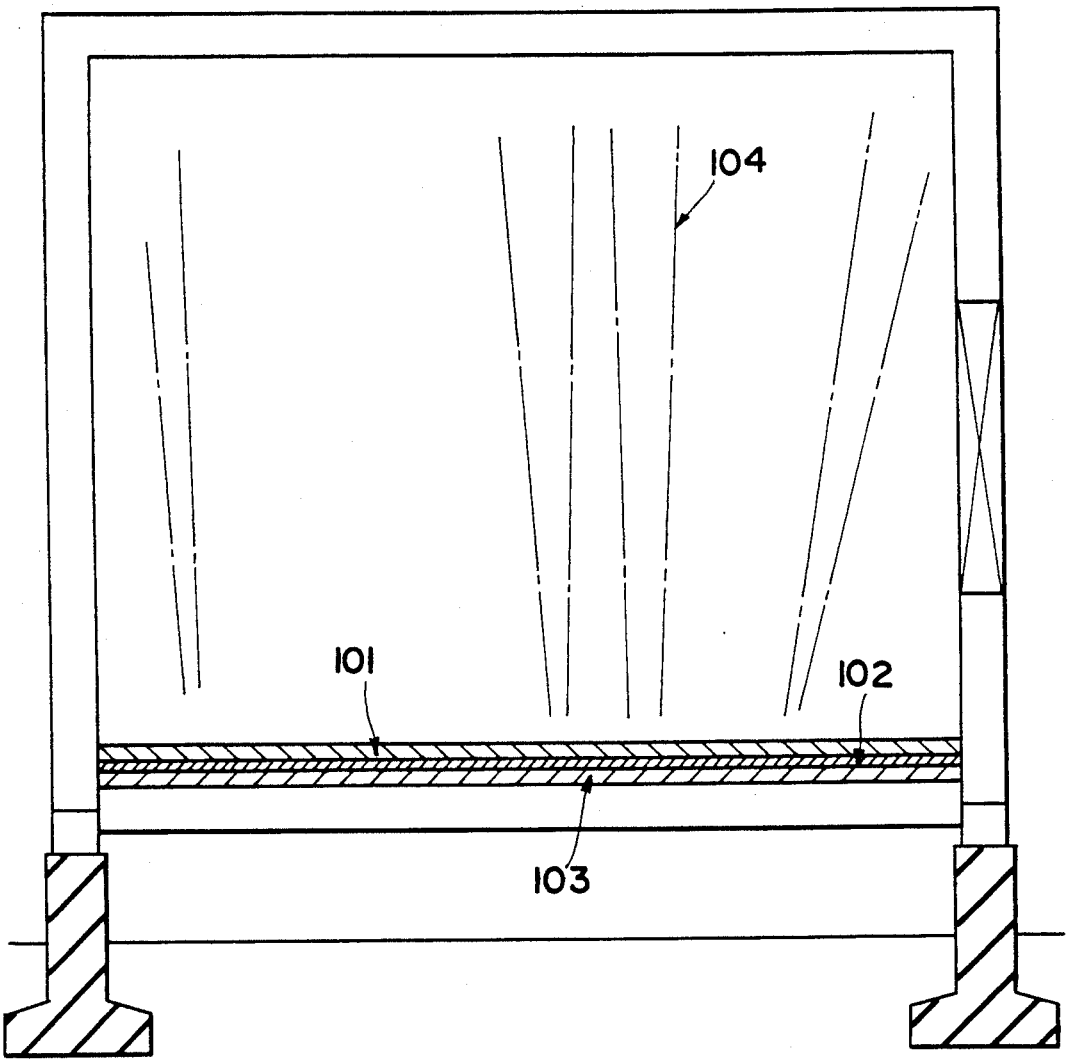
FIG. 8 is a schematic sectional view of one form of a far-infrared-ray panel heating structure embodying the present invention.
Figure 9:
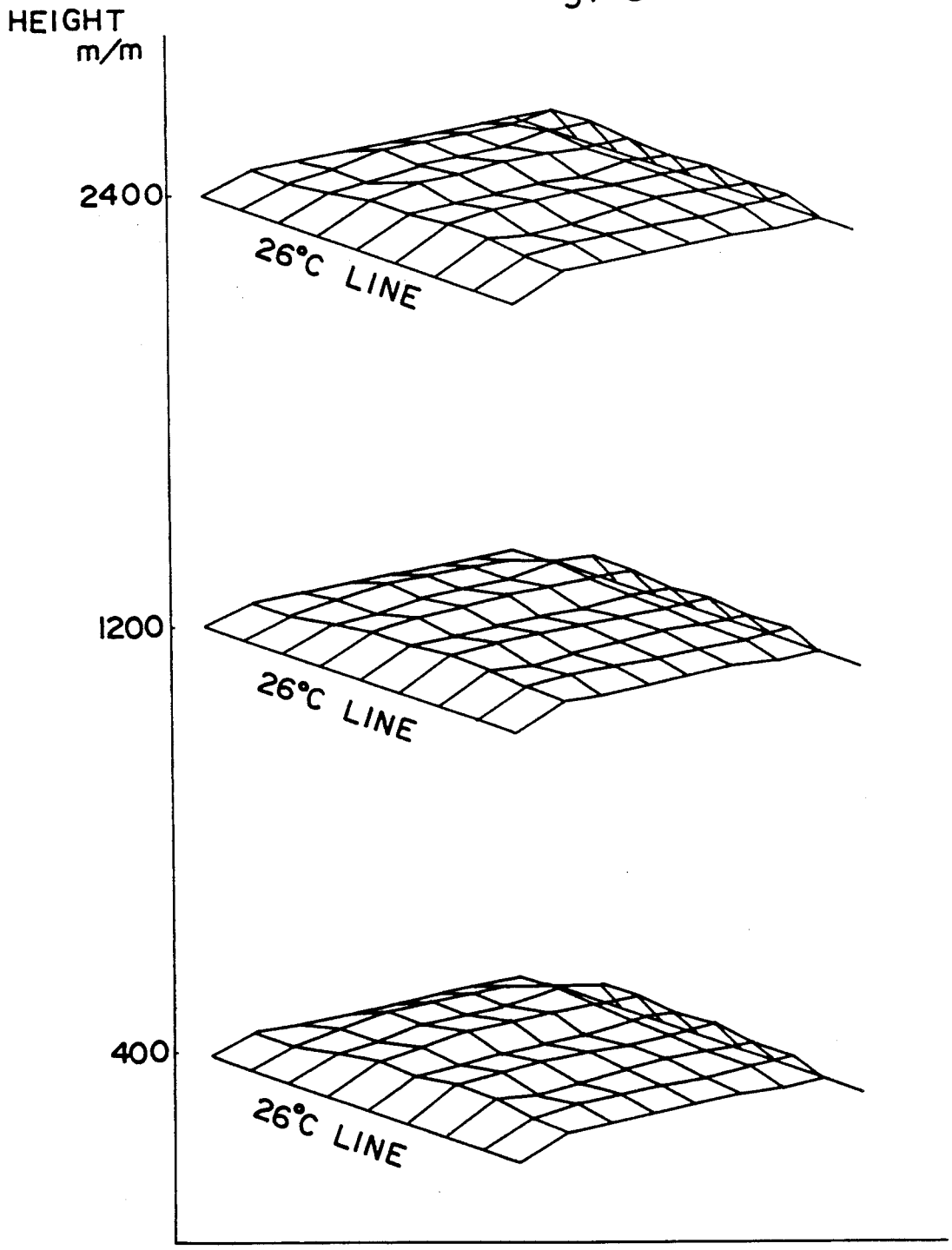
FIG. 9 is a graph showing the result of heating experiments conducted by using the embodiment of FIG. 8.

A far-infrared-ray panel heator according to the present invention will now be described, referring to FIGS. 8 and 9. Although this far-infrared-ray panel heater may be used for floor heating, lateral heating, ceiling heating, etc., the floor heating is illustrated in FIG. 8 as an examplar.

Floor panels 101 are made of wooden plates such as a Japanese cedar, a Japanese chestnut tree, a paulownia, etc. which have been subjected to the treatment for impregnating a synthetic resin (comprising a base of formaldehyde and a crosslinking agent of alkyd resin. A heat source 102 is disposed under the floor panels 101 and a heat insulator 103 is in turn provided under the heat source 102.

According to the results of the experiments conducted by the inventors, using the floor heater as illustrated, far infrared rays 104 is radiated from the floor panels 101 when the floor panels 101 are heated to a temperature of 40° C. As a result of this, persons or things on the floor, walls and ceilings are all warmed. In addition, moisture in air is also warmed by the far infrared rays. Thus, the air in the entire room is uniformly warmed from the floor to the ceiling. At this time, the region ranging from 10 cm above the floor and the ceiling and the four corners are at a temperature of 26° C. Thus, it can be seen that not only on the floor, but the entire space of the room is warmed at a confortable temperature by the far-infrared-ray floor heating system (Refer to FIG. 9).

I claim:

1. A method for impregnating a liquid such as a resinous liquid into wood in a pressure tank which is capable of increasing or reducing an interior pressure, which method comprises:

(a) a step for evacuating the inside of the pressure tank, which contains timbers to be impregnated with the liquid through an evacuation line outside of the pressure tank and through a monitoring timber located outside of said pressure tank and substantially identical with said timbers which is connected to said evacuation line; and (b) a step for injecting the liquid into the pressure tank under pressurized conditions, while continuing the evacuation of the inside of the tank through such evacuation line and said monitoring timber;

the impregnation of the timbers in the pressure tank with the liquid being continued until the liquid begins to be drawn out of the pressure tank through the evacuation line monitoring timber as evidenced by dripping of liquid from said monitoring timber.

2. A method as claimed in claim 1, in which said timbers are subjected to a pretreatment to substitute a hydroxyl group in cells of the timbers with a hydrophobic group.

3. A method as claimed in claim 2, in which said hydroxyl group in the timbers to be treated is substituted with 2% formalin to effect formalization and then 15 wt % of the liquid based on the weight of the timbers is impregnated into the formalized timbers.

4. A method for impregnating a liquid such as a resinous liquid into wood in a pressure tank which is capable of increasing or reducing an interior pressure, which method comprises:

(a) a step for charging timbers to be impregnated in a container having an opening at a top thereof, filling the container with the liquid and placing the container in the pressure tank;

(b) a step for evacuating air in the pressure tank to reduce the interior pressure of the pressure tank so that the air present in the timbers to be impregnated is expelled together with the air in the tank;

(c) a step for forming another evacuation line initiating from the container, placing a monitoring timber identical or similar, in properties, with or to the timbers to be impregnated at an intermediate position of said another evacuation line, and evacuating the inside of the container by a suction force larger than a suction force for the pressure tank to expel the air present in the liquid or adhering to surfaces of the timbers from the pressure tank., and (d) a step for pressurizing the inside of the pressure tank, while continuing the pressure reducing of the interior pressure of the pressure tank to impregnate the timbers with the liquid, while expelling the air retained in the container and/or the residual air in the timbers.

5. A method as claimed in claim 4, in which said timbers are subjected to a pretreatment to substitute a hydroxyl group in cells of the timbers with a hydrophobic group.

6. A method as claimed in claim 5, in which said hydroxyl group in the timbers to be treated is substituted with 2% formalin to effect formalization and then 15 wt % of the liquid based on the weight of the timbers is impregnated into the formalized timbers.

7. A method for impregnating a liquid such as a resinous liquid into wood submerged in the liquid in a tank which is capable of increased or reduced interior pressure by the operation of pressurizing means connected to said tank by an outlet line from said pressurizing means and by the operation of first and second evacuation means connected to said tank by respective evacuation lines, the second evacuation means being capable of a greater suction force than the first evacuation means to enable evacuation of impregnating liquid from said tank through its respective evacuation line, said process comprising:

pressurizing said tank by operation of said pressurizing means through its outlet line;

evacuating air from said tank by operation of said first evacuating means through its evacuation line;

evacuating impregnating liquid from said tank by operation of said second evacuating means through its evacuation line;

providing a monitoring timber connected in the evacuation line of the second evacuating means between said tank and said second evacuating means; and visually observing the commencement of dripping of impregnating liquid from said monitoring timber as indication of completion of impregnation of the timbers in said tank.

* * * * *